United States Patent [19]

Kobler

[11] Patent Number: 4,637,674

[45] Date of Patent: Jan. 20, 1987

[54] ANNULAR CONNECTOR SEAL

[75] Inventor: Robert J. Kobler, Harrisburg, Pa.

[73] Assignee: AMP Incorporated, Harrisburg, Pa.

[21] Appl. No.: 735,889

[22] Filed: May 17, 1985

[51] Int. Cl.[4] ..... H01R 4/00

[52] U.S. Cl. ..... 339/94 M; 339/60 M

[58] Field of Search ..... 339/94, 59, 60, 61, 339/91 R

[56] References Cited

U.S. PATENT DOCUMENTS

| | | | |
|---|---|---|---|
| 1,876,989 | 9/1932 | Lormor . | |
| 3,703,296 | 11/1972 | Malmstrom . | |
| 4,029,382 | 6/1977 | Koda | 339/94 M |
| 4,193,655 | 3/1980 | Herrmann, Jr. | 339/94 M |
| 4,305,595 | 12/1981 | Miyagishima et al. . | |
| 4,311,355 | 1/1982 | Plyler et al. | 339/94 R |
| 4,312,553 | 1/1982 | Lyckesjo | 339/60 M |
| 4,376,563 | 3/1983 | Margrave et al. . | |

*Primary Examiner*—Gil Weidenfeld
*Assistant Examiner*—David L. Pirlot
*Attorney, Agent, or Firm*—Anton P. Ness

[57] ABSTRACT

An annular sealing member is a ring-like article molded from relatively incompressible elastomeric material and having an axially extending body section with at least one and preferably two annular ribs extending radially outwardly from the body section. Such a sealing member is seated in an annular groove around a plug section of a cylindrical connector housing tightly thereagainst. When the plug section is axially inserted into a hood section of a mating connector housing, the annular ribs are engaged by the inner surface of the hood section, are deformably bent over thereby, and transmit radially inward compressive force to deform the sealing member body section sealingly against the plug section, and thus form an annular sealing engagement between the housings. A plurality of ribs provides for plural sealing areas, or redundant sealing.

10 Claims, 7 Drawing Figures

12
18
20
22
14
24
32
36
34
36
38
30
78
76
80B
82
80A
70
72
78
42
44
48
50
54
62
64
66
68

ANNULAR CONNECTOR SEAL

FIELD OF THE INVENTION

This relates to the field of electrical connectors and more particularly to the field of sealing means for electrical connectors.

BACKGROUND OF THE INVENTION

Electrical connectors are known which use annular sealing members to provide annular sealing between a plug portion of one dielectric connector housing and a hood or sleeve portion of a second dielectric connector housing therearound. Sealing is accomplished by the sealing member being pressed firmly between the surfaces of the two housings around the circumference, deforming the member which is of a relatively incompressible elastomeric material.

Typically such sealing members are O-rings and tubular sleeves. An O-ring is a toroid having a relatively circular cross section through the body and is commonly seated in an annular groove around the plug portion of the inner housing. Space is provided either in the groove or between the housing surfaces or both to allow for the O-ring to be elastically deformed. A significant portion of the circular cross section extends radially outward from the groove beyond the side of the inner housing and also beyond the point where the inside surface of the outer housing will be situated when secured around the inner housing. This outermost extent of the O-ring cross section involves enough bulk which needs to be deformed inwardly by the outer housing that significant resistance must be overcome. There is a tendency for a conventional O-ring to "roll" when the outer housing is urged axially alaong the inner housing therearound, and to twist and not properly seal between the two housings.

It is desired to provide an annular sealing member which requires less force to insert the plug section of an inner housing into the sleeve section of an outer housing. It is further desired to provide an annular sealing member which has a reduced tendency to roll or twist and possibly not sealingly engage between the two housings. It is further desired to provide an annular sealing member which has a lower coefficient of friction.

SUMMARY OF THE INVENTION

An annular sealing member is provided comprising a body section outwardly from which extend a plurality of annular ribs. The member is ring-like and body section has a limited axial dimension and is preferably seated in an annular groove on the outer surface of a plug portion of an inner housing. The ribs are engaged by the inner surface of a sleeve portion of an outer housing inserted axially over the plug portion of the inner housing. The annular sealing member is preferably made of a relatively incompressible elastomeric composition and most preferably of a composition having inherent lubricity. Upon mating of the connector housings, the annular ribs are deformed forwardly into either gaps between the ribs or the space forwardly of the innermost rib, and the annular sealing member may also be deformed into the previously unoccupied space in the annular groove in which it is seated. Such an annular sealing member provides less bulk to be deformed and less resistance to the axial mating of the housings. It also provides a plurality of areas for sealing between the housings corresponding to each rib which could be termed redundant sealing. Such a sealing member preferably has inherent lubricity and therefore a substantially lower coefficient of friction and results in less tendency to roll or twist.

DETAILED DESCRIPTION OF THE PREFERRED EMBODIMENT

Figure 1:
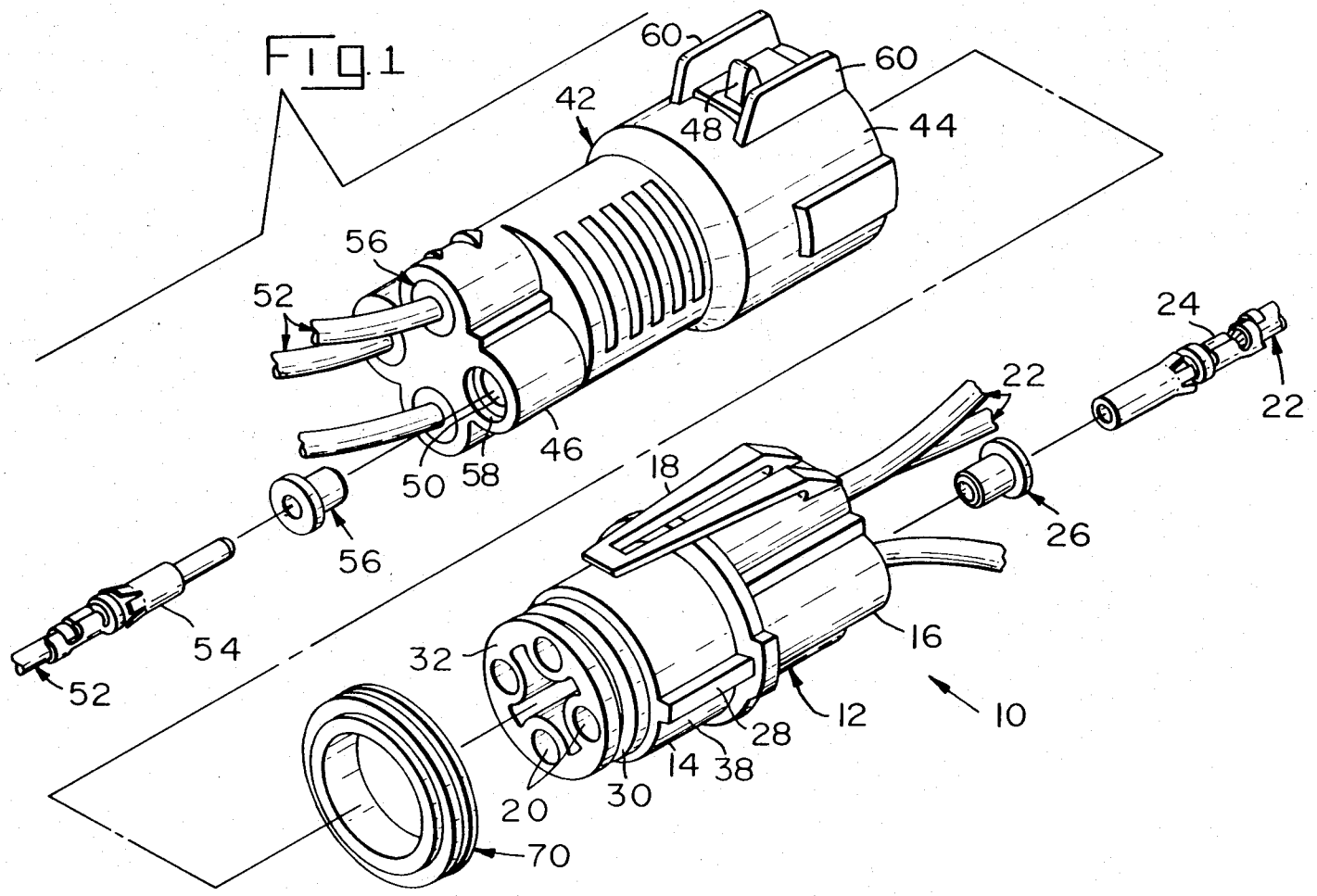
FIG. 1 is an exploded perspective view of a connector assembly utilizing the annular sealing member of the present invention.

FIG. 1 illustrates a connector assembly 10 with which the annular sealing member 70 of the present invention is used. A first connector housing 12 has a forward or plug section 14, a rear section 16, latch arms 18, and a plurality of terminal-receiving cavities 20 extending axially therethrough. Conductors 22 have socket terminals 24 terminates on forward ends thereof; wire seals 26 are disposed in rear portions of cavities 20 and sealingly engage around insulated portions of respective conductors 22. Keying ridges 28 extend axially along the peripheral surface 38 of plug section 14.

A second connector housing 42 has a forward sleeve-like hood section 44, a rear section 46, latch projections 48, and a plurality of terminal-receiving cavities 50 extending axially therethrough. Conductors 52 have pin terminals 54 terminated on forward ends thereof; wire seals 56 are disposed in rear portions 58 of cavities 50 and sealingly engage around insulated portions of respective conductors 52. Keying channels (not shown) extend axially along hood section 44 therewithin corresponding to keying ridges 28 of mating housing 12. A pair of protective ribs 60 extend axially proximate to but radially spaced from each latch projection 48.

Figure 2:
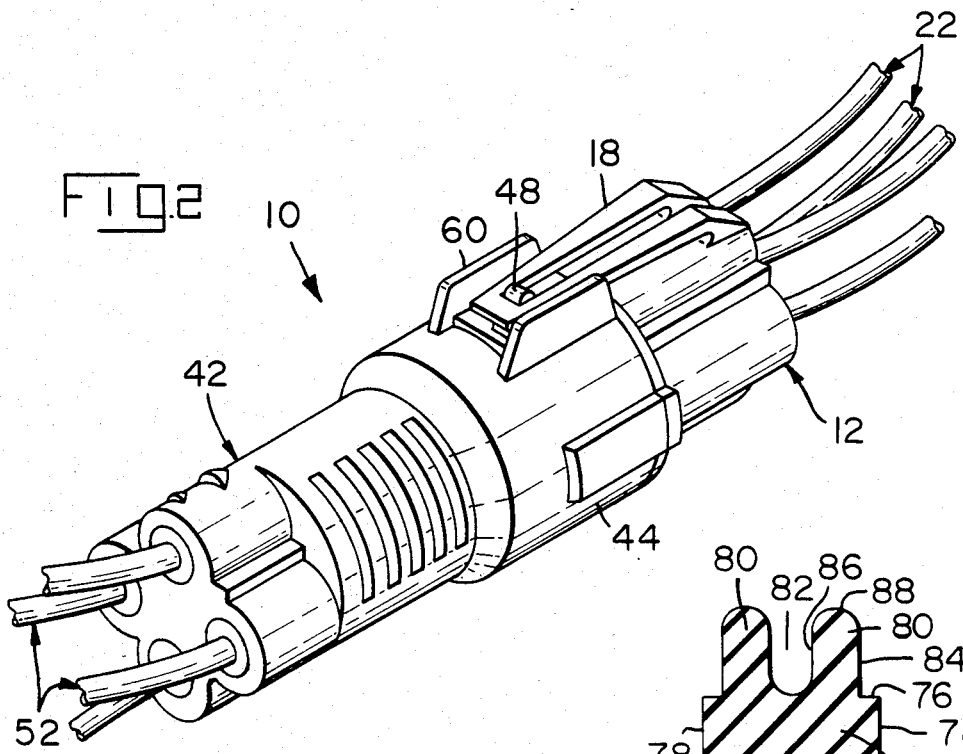
FIG. 2 is a perspective view of the assembly of FIG. 1 assembled.

As seen in FIG. 1, plug section 14 of housing 12 has an annular groove 30 therearound in peripheral surface 38 thereof, spaced from front surface 32. Ring-like annular sealing member 70 will be disposed in annular groove 30 prior to mating housing 12 and 42. FIG. 2 shows the assembled sealed connector assembly 10 with housing 12 latchingly engaging housing 42, and hood section 44 containing plug section 14 therewithin and the pin and socket terminals electrically engaged therewithin. Terminated conductors 22 and 52 had been secured in respective terminal-receiving cavities 20, 50 of housings 12, 42 prior to mating housings 12 and 42 together. Keying ridges 28 and respective keying channels polarized the housings with respect to each other for appropriate mating. Latch arms 18 are latched behind latch projections 48. Protective ribs 60 protect the latch arms 18 from being inadvertently caught by stray wires.

Figure 3:
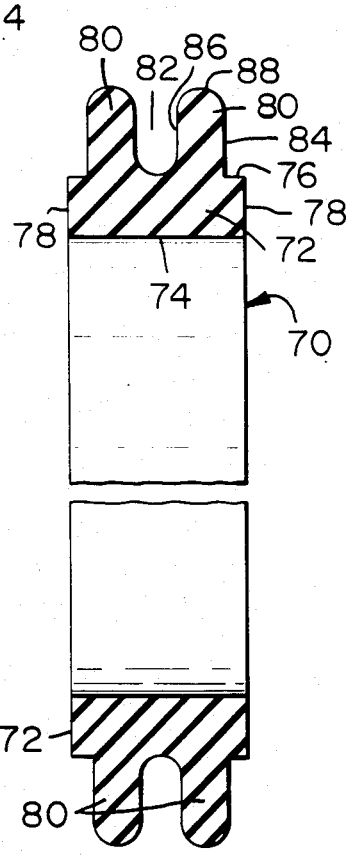
FIG. 3 is a cross-sectional view of the annular sealing member.

A preferred embodiment of annular sealing member 70 is shown in FIG. 3 in cross section taken axially. An axially extending body section 72 of substantially rectangular cross-section has an axial dimension of preselected length, coaxial substantially flat inner surface 74, general outer surface 76, and front and rear surfaces 78. The axial dimension of body section 72 is less than one-third the inner diameter of annular sealing member 70, being ring-like instead of sleeve-like, and the general radial thickness of body section 72 is less than its axial dimension, such as roughly one-half of its axial dimension, shown in FIG. 3. A pair of similar annular ribs 80 extend radially outwardly from body section 72 with a gap 82 between ribs 80. Each of ribs 80 has a forward surface 84, a rearward surface 86, and a tip section 88. The outward extent of annular ribs 80 is determined by the spacing between the inner and outer housings with which the annular sealing member will be used. It is preferred that annular sealing member 70 be made of relatively incompressible elastomeric material such as neoprene. It is more preferred that such a material have inherent lubricity such as the composition disclosed in U.S. patent application Ser. No. 735,418 filed May 17, 1985. Body section 72 should have an inner diameter which is approximately equal to and preferably slightly less than the diameter of the plug section of a housing taken through the annular groove thereof within which the annular sealing member will be seated. Body section 72 should extend axially beyond ribs 80 to provide stability during deformation. In such a two-rib member 70, body section 72 should therefore have an axial dimension about four times the width of one of ribs 80.

Figure 4:
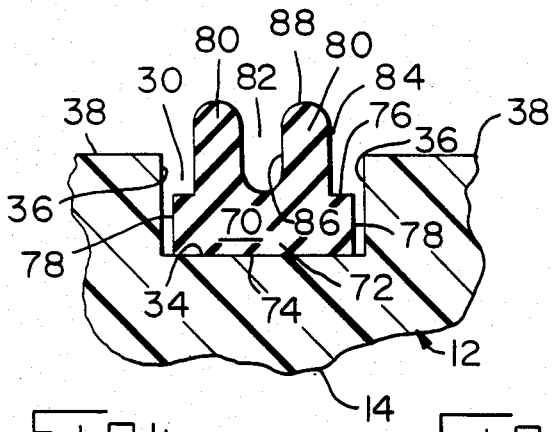
FIG. 4 is a cross section of the annular sealing member in a housing groove.

In FIG. 4, annular sealing member 70 is disposed in annular groove 30 adjacent bottom surface 34 thereof. The axial dimension of body section 72 is such as to be preferably slightly less than the width of annular groove 30. Inner surface 74 is preferably snug against substantially flat and coaxial groove bottom 34; body section 72 preferably allows a slight space between front and rear surfaces 78 and groove sidewalls 36; and general outer surface 76 of sealing member 70 is preferably disposed within groove 30 and below general peripheral surface 38 of plug section 14. Annular ribs 80 extend upwardly from groove 30 substantially beyond general peripheral surface 38 to be engaged by an inside surface portion of the hood section of the mating connector housing. Ribs 80 preferably have axially normal forward and rearward surfaces 84, 86 and rounded tip sections 88. Ribs 80 have a height or radially outward dimension equal to or greater than their width or axial dimension, and preferably are 150 to 250 percent as high as they are wide, and most preferably 200 percent. Gap 82 therebetween is preferably about as wide as the width of each rib 80, ribs 80 preferably but not necessarily being identical.

Figure 5A:
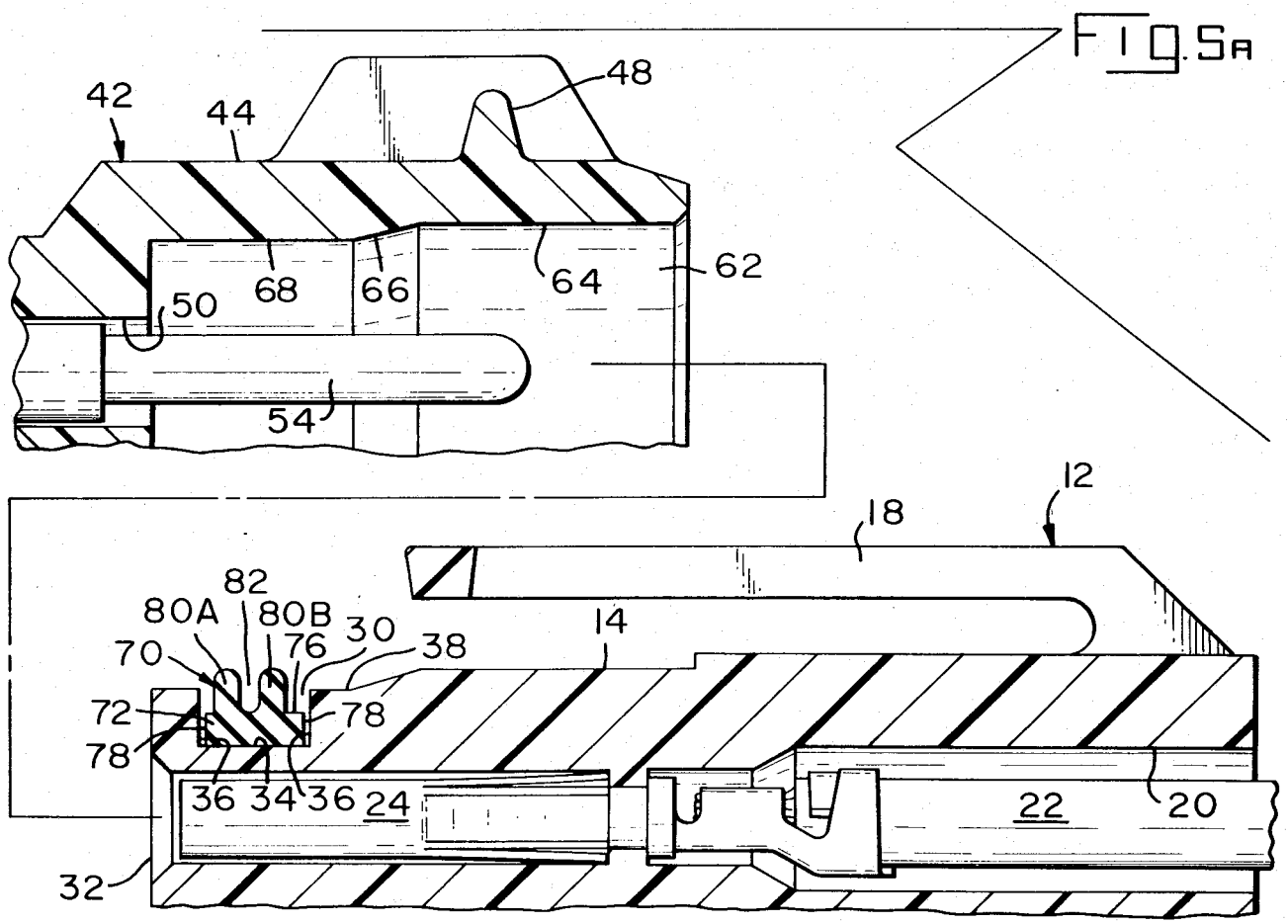
FIGS. 5A, 5B and 5C are part longitudinal section views which illustrate the process of mating of the connector housings of FIG. 1 using the annular sealing member of FIG. 3.
Figure 5B:
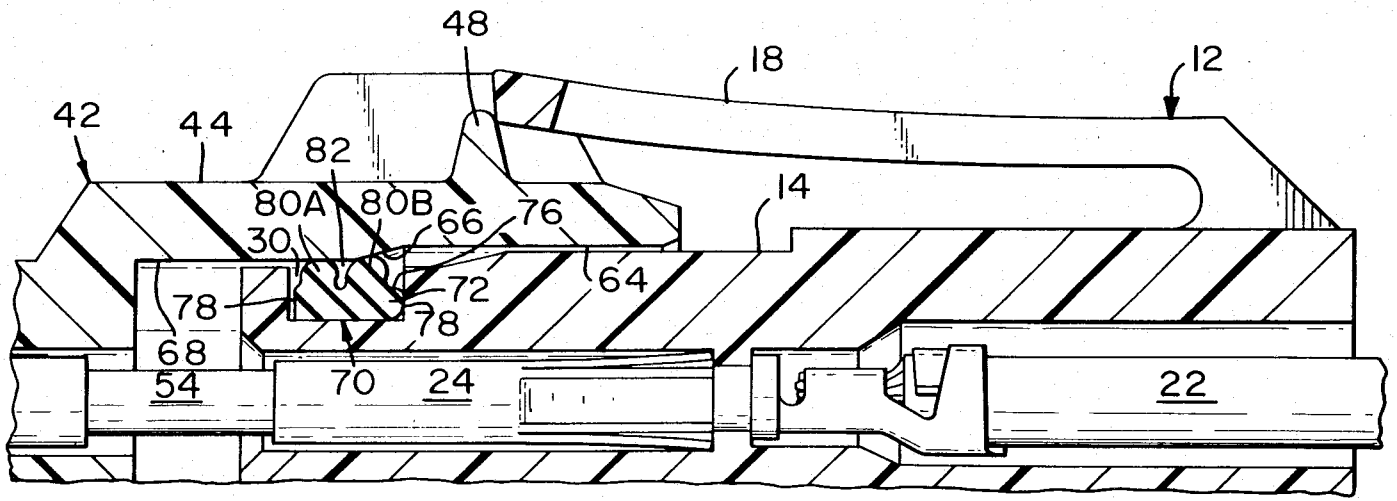
Figure 5C:
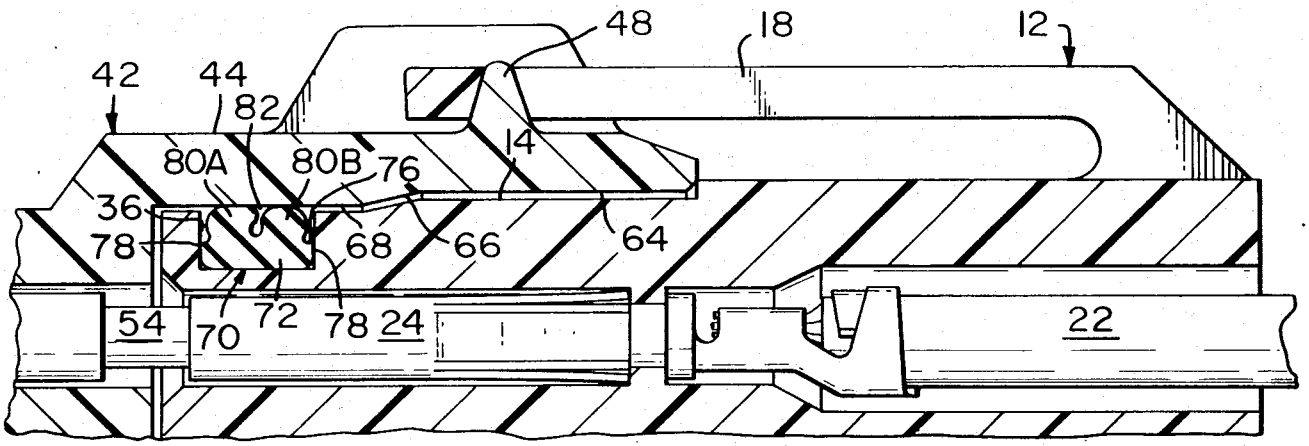

In FIGS. 5A, 5B and 5C, a typical mating sequence is shown mating housing 12 with housing 42. Housing 12 is to be moved axially toward housing 42; in FIG. 5B, plug section 14 enters plug-receiving cavity 62 defined by hood section 44; and in FIG. 5C, mating and latching is complete with sealing engagement having occurred. In FIG. 5A, housing 12 has annular sealing member 70 seated in groove 30 around plug section 14. Latch arm 18 is shown extending forwardly from an integral joint with housing 12. Latch projection 48 extends radially outward from hood section 44 of housing 42. Latch projection 48 and cooperating latch arm 18 are preferred to be of the type disclosed in U.S. patent application Ser. No. 737,447 filed May 17, 1985. Other conventional latching means (simultaneously herewith). Other conventional latching means may be used with the present invention, however.

Ribs 80 of annular sealing member 70 have an appropriately selected radially outward dimension which is based on the difference between the inside diameter of hood section 44 and the outer diameter of plug section 14. In FIG. 5B, tip sections 88 of ribs 80 are first engaged by forward inner surface 64 by hood section 44, then inwardly tapered inner surface portion 66, and then rearward inner surface 68 of hood section 44 having a reduced diameter from forward inner surface 64; and ribs 80 are urged or bent over axially rearwardly thereby. The roward rib 80 is designated as 80A and the rearward rib as 80B. Latch arm 18 rides over latch projection 48 and, in FIG. 5C, latches therebehind which indicates full mating of housing 12 with housing 42, with annular sealing member 70 in sealing engagement between housings 12 and 42, and with pin terminals 54 in electrical engagement within socket terminals 24.

During the mating of housing 12 and housing 42, ribs 80A and 80B are bent over and deformably urged axially rearwardly, and also radially inwardly, by frictional engagement with inner surfaces 64, 66 and 68 of hood section 44 of housing 42. Forward rib 80A can be seen in FIG. 5B to be deformed into gap 82 between ribs 80A, 80B, and rearward or innermost rib 80B is deformed into the space rearwardly therefrom and above general outer surface 76 of body section 72. In FIG. 5C it can be seen that ribs 80A and 80B have transmitted to body section 72 radially inward compressive force applied by hood section 44. Ribs 80A and 80B and body section 72 have been deformed to practically fill the space above general outer surface 76 of body section 72, gap 82, and the spaces between front and rear surfaces 78 and groove sidewalls 36. Ribs 80A and 80B engage rearward inner hood surface 68 of housing 42 at somewhat separate locations, providing redundant sealing. When annular sealing member 70 is made of the more preferred composition having inherent lubricity, the frictional resistance due to the engagement of member 70 with surfaces 64, 66 and 68 is substantially reduced, leaving primarily the resistance due to deformation, which is also reduced due to lower bulk requiring deforming, compared to a conventional O-ring. With annular sealing member 70 having a rectangular cross-section body section 72 with an axial dimension, there is much reduced tendency of the annular sealing member to roll over or twist when housings 12 and 42 are mated.

The annular sealing member of the present invention preferably has at least two annular ribs with a sufficient gap therebetween to allow for axial deformation or "bending over" thereinto of the outer ends of all but the rearwardmost rib, which also is similarly bent over into the space above general outer surface 76. Each annular rib provides for sealing, and a plurality of ribs provides for a plurality of sealing engagements or redundancy which is preferred.

An annular sealing member having a relatively short axial dimension is easy to install in a groove in a manner similar to the manner in which a conventional O-ring is installed, as opposed to that for a sealing sleeve having a substantial axial dimension. Such a sleeve practically must be stretched over peripheral surfaces of a length of a plug section of a housing instead of placement in a groove, to compensate for tolerances in the manufacture of the sleeve and the outer diameter of the plug section of the housing over which the sleeve is to be disposed and also to retain the sleeve on the housing, which can complicate the placing of the sealing sleeve thereover. Also, such stretch is permanent because the sleeve is not placed in a groove having a diameter relatively equal to the inner diameter of the sleeve to allow it to relax, which could eventually cause material fatigue.

During the molding of the annular sealing member, it is preferred to provide the mold gate along a side surface of the body section 72 as opposed to inner surface 74 general outer surface 76 or along any portion of a rib 80.

Variations in the design of the annular sealing member may occur without departing from the spirit of the invention or the scope of the claims. Such an annular sealing member may be useful to provide sealing engagement between a component and a mating component other than two mating connector housings, wherever lower mating resistance is desired or redundant sealing capability is desired or both, from that associated with the use of conventional O-rings.

What is claimed is:

1. An assembly of a component and an annular sealing member comprising:

a cylindrical component including a plug section having a peripheral surface, said peripheral surface having an annular groove therearound having a preselected axial dimension and a substantially flat coaxial bottom surface having a preselected diameter; and an annular sealing member comprising a ring-like article molded from a relatively incompressible elastomeric composition, said article having an axially extending body section, a coaxial substantially flat inner surface, a general outer surface substantially parallel to said inner surface, opposing front and rear surfaces, and at least one elastically deformable annular rib extending radially outwardly from said general outer surface of said body section, said body section having an axial dimension less than said preselected axial dimension of said annular groove, and said inner surface having a diameter approximately equal to said preselected diameter of said bottom surface of said annular groove;

said annular sealing member being seated in said annular groove of said component such that said inner surface of said body section is adjacent said bottom groove surface, said general outer surface is disposed within said annular groove, and said at least one annular rib extends radially outwardly beyond said periphral surface of said component, whereby when said plug section of said component with said annular sealing member thereon is axially inserted into a corresponding sleeve-like portion of a mating component, said at least one annular rib is engageable by an inner surface of said sleeve-like portion and is deformably urged axially rearwardly and inwardly thereby, and thereby capable of forming an annular sealing engagement between said inner surface of said sleeve-like portion of said mating component and said plug section of said component.

2. An assembly as set forth in claim 1 wherein said annular sealing member has two said annular ribs having a gap therebetween, each capable of providing sealing engagement with said component and said mating component.

3. An assembly as set forth in claim 1 wherein said annular sealing member has inherent lubricity.

4. An assembly as set forth in claim 1 wherein said component is a first housing member for a first electrical connector, and said mating component is a second housing member for a second electrical connector and is matable with said first housing member to form an electrical connector assembly.

5. An assembly as set forth in claim 1 wherein said inner surface of said annular sealing member defines an inner diameter substantially equal to said preselected diameter of said bottom surface of said groove, and said body section has an axial dimension less than one-third said inner diameter and a general radial dimension less than said axial dimension.

6. An assembly as set forth in claim 5 wherein said general radial dimension of said body section of said annular sealing member is about one-half said axial dimension thereof.

7. A sealed electrical connector assembly comprising a first electrical connector including a first dielectric housing having a plug section forwardly thereof with an annular groove therearound, a second electrical connector including a second dielectric housing having a hood section to receive said plug section thereinto, and a ring-like annular sealing member seated in said annular groove, wherein said annular sealing member has a general outer surface disposed within said annular groove with at least one annular rib extending radially outward from said general outer surface and beyond a peripheral surface of said plug section of said first dielectric housing, said at least one annular rib deformably pressed against an inner surface of said hood section of said second dielectric housing and therearound, and in sealing engagement between said first and second dielectic housings.

8. A sealed electrical connector assembly as set forth in claim 7 wherein said annular sealing member has two said annular ribs spaced therebetween each in sealing engagement between said first and second dielectric housings.

9. A sealed electrical connector assembly as set forth in claim 7 wherein said ring-like annular sealing member has an axial dimension less than one-third the inner diameter thereof, and a general radial dimension less than said axial dimension.

10. A sealed electrical connector assembly as set forth in claim 9 wherein said general radial dimension of said body section of said ring-like annular sealing member is about one-half said axial dimension thereof.

* * * * *